US007823307B2

(12) United States Patent
Gibbs

(10) Patent No.: US 7,823,307 B2
(45) Date of Patent: Nov. 2, 2010

(54) ORIENTATION DEVICE OF OR FOR A ROTATABLE DISPLAY BOX

(75) Inventor: Graham Rodier Gibbs, Auckland (NZ)

(73) Assignee: Rodier Advertising (1986) Limited, Auckland (NZ)

( * ) Notice: Subject to any disclaimer, the term of this patent is extended or adjusted under 35 U.S.C. 154(b) by 499 days.

(21) Appl. No.: 11/793,032

(22) PCT Filed: Sep. 9, 2005

(86) PCT No.: PCT/NZ2005/000236

§ 371 (c)(1),
(2), (4) Date: Apr. 21, 2008

(87) PCT Pub. No.: WO2006/028394

PCT Pub. Date: Mar. 16, 2006

(65) Prior Publication Data

US 2008/0209780 A1 Sep. 4, 2008

(30) Foreign Application Priority Data

Sep. 9, 2004 (NZ) ..... 535259

(51) Int. Cl.
*G09F 19/00* (2006.01)
*G09F 11/02* (2006.01)
*E05F 1/02* (2006.01)
*E05F 1/04* (2006.01)

(52) U.S. Cl. ..... 40/493; 40/503; 40/504; 40/505; 40/506; 16/312; 49/239

(58) Field of Classification Search ..... 40/493, 40/503, 504, 505, 506; 16/312; 49/239
See application file for complete search history.

(56) References Cited

U.S. PATENT DOCUMENTS

| | | | | |
|---|---|---|---|---|
| 4,597,209 A | | 7/1986 | Hukill | 40/447 |
| 5,233,772 A | | 8/1993 | Bergeron et al. | 40/503 |
| 5,822,900 A | * | 10/1998 | Armstrong | 40/473 |
| 5,970,819 A | | 10/1999 | Katoh | 74/531 |
| 6,128,841 A | | 10/2000 | Werner | 40/505 |

FOREIGN PATENT DOCUMENTS

| | | |
|---|---|---|
| EP | 0938070 A1 | 8/1999 |
| GB | 1511994 | 5/1978 |
| NZ | 504716 | 4/2002 |
| NZ | 527697 | 4/2006 |

* cited by examiner

*Primary Examiner*—Lesley Morris
*Assistant Examiner*—Syed A Islam
(74) *Attorney, Agent, or Firm*—Jacobson Holman PLLC

(57) ABSTRACT

A rotatable display box comprising, a signage body and mount to engage this to a fixed structure in a manner to allow the signage body to be rotatable about an axis of rotation and relative to said fixed structure. The signage body includes at least two display sides. A cam and the other is a cam follower are included. The cam has a surface including a number of cam surface depressions corresponding to the number of regions at or from which signage is or can be presented, said cam surface depressions located at intervals about said axis or rotation corresponding to the number of display sides of the signage box to which said rotation is to be biased to. The biasing to such locations is encouraged by the biasing of said cam follower towards the cam surface of said cam.

24 Claims, 6 Drawing Sheets

Figure 1:
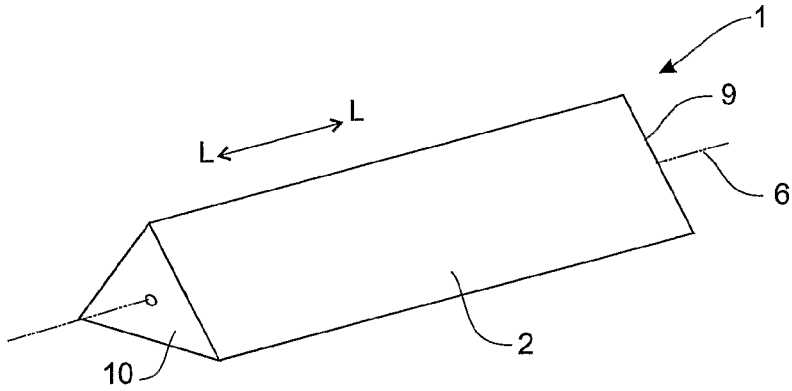

FIGURE 11
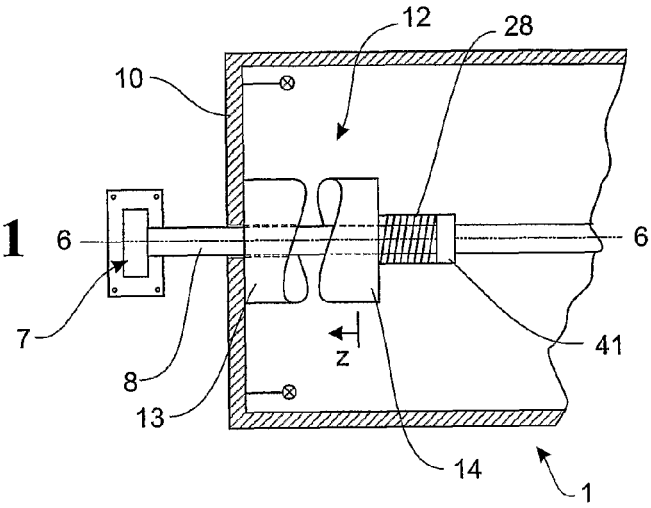
FIGURE 12
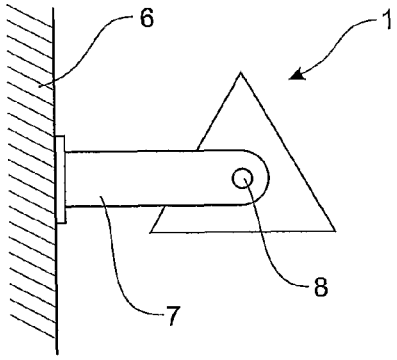
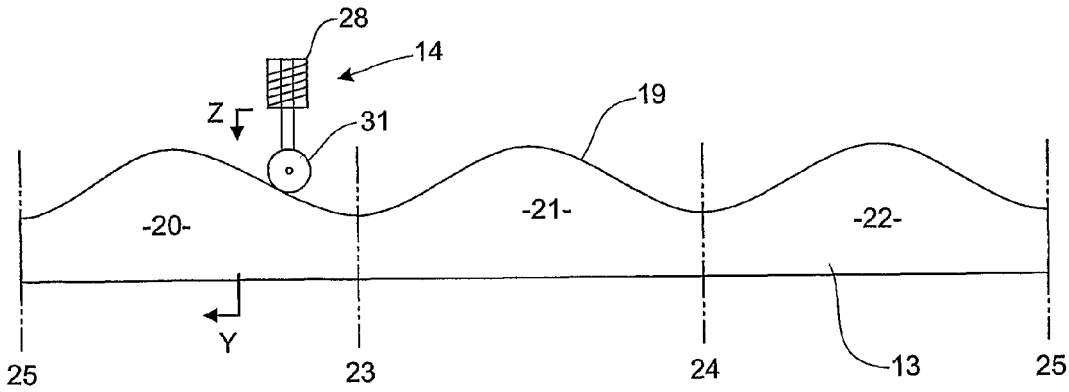
FIGURE 13

ORIENTATION DEVICE OF OR FOR A ROTATABLE DISPLAY BOX

This is a national stage of PCT/NZ05/000236 filed Sep. 9, 2005 and published in English.

FIELD OF THE INVENTION

The present invention relates to an orientation device of or for a rotatable display box or a device and method of rotation of a display box having multiple-sided display in particular although not solely but preferably for the use in a menu display box.

BACKGROUND OF THE INVENTION

A display box for presenting billboards or menu boards or advertisements or similar are in extensive use. The display box can be defined as a tool for presenting information and communication which promotes purchase of products or services. Such commonly comprise of a fixed structure which defines a frame or perimeter within the bounds of which an image carrying substrate can be engaged for presentation by the device. These display boxes are commonly one-sided and can only present one image. Such a display box may be used as menu boards in for example fast food chains. They are commonly one-sided and they are usually mounted vertically to a ceiling or wall behind the order counters. As such, some customers who are short are not able to see the items on the menu clearly because it is not clearly within their range of visibility. A further disadvantage of a one-side menu boards is that they can only display a fixed menu and it would require a person to take down the menu board or a removable insert containing menu information if there are any changes to the menu. This is inconvenient and time consuming.

It is now more than ever important for merchants to devise ways of exploiting the display box medium for advertising purposes so as to rapidly exploit commercial opportunities. Hence many display apparatuses or advertising technologies have been developed to cope with the rapid and increasing possible need for the aforementioned advertising purposes. On such display apparatus that many retailers use are signage of multiple face displays which are changeable in orientation so as to give them the ability to control the visibility of content, inform customers of current products or services or special promotions, educate customers on products and services. Such display apparatus also provide solutions to retailers who are challenged with making the most efficient use of space without producing cluttering that turns customers away. Display apparatus capable of meeting such needs are often mounted to the wall, for example in point-of-sales signs or three-sided menu boards for displaying breakfast, lunch and dinner menu. It is accordingly known to find a display box with multiple faces. Each face may carry a different image or display in a housing or casing which is rotatable so as to allow the selective display of information from different faces. To rotate from one image displayed on one face of the display box to another image on another face requires manual rotation by a person to a predetermined orientation. In order for the customers to clearly see the information, services or products being presented on the face of a multiple sided display box, it is important that the face is presented at an angle in such a way that the information can be easily visible to customers standing at the counter so as to make purchase. This is important especially in point-of-sale applications, for example fast food restaurants or cafes. Such rotatable signs as for example shown in our New Zealand patent NZ504716, are not secured in place at an angle of rotation a person rotating the sign may find it inconvenient and time consuming to determine if the sign is rotated to the correct orientation. This may particularly be so where during one day, one or two exchanges of image carrying substrates need to occur as for example is often required at fast food outlets.

Accordingly it is an object of the present invention to provide an orientation device of or and for rotation of a display box having multiple-sided display which addresses the abovementioned disadvantages or which will at least provide the public with a useful choice.

BRIEF DESCRIPTION OF THE INVENTION

Accordingly in a first aspect the present invention consists in a rotatable display box comprising a signage body a means to mount said signage body to a fixed structure in a manner to allow the signage body to be rotatable about an axis of rotation and relative to said fixed structure wherein said signage body includes at least two regions at or from which signage is or can be presented, said regions being provided disposed for viewing of said signage from a location outwardly away (ie not from a location on said axis of rotation) from the axis of rotation a means carried by said signage body for rotation about said axis of rotation and a means interactive with said means carried by said signage body said means interactive held stationary relative to any rotation of said signage body about the axis of rotation, wherein one of (a) said means carried by said signage body and (b) said means interactive, is a cam and the other is a cam follower, said cam presenting a cam surface to displace the cam follower parallel to the axis of rotation, said cam surface including a number of cam surface depressions corresponding to the number of regions at or from which signage is or can be presented, said cam surface depressions located at intervals about said axis of rotation corresponding to rotational locations of said signage box to which said rotation is to be biased to, said biasing to said locations encouraged by the biasing of said cam follower towards the cam surface of said cam.

Preferably said cam surface is continuous about said axis of rotation.

Preferably said signage body is free to rotate at least one complete revolution.

Alternatively said cam surface is non continuous about said axis of rotation and said rotation of said signage body is not through 360 degrees about said axis of rotation.

Preferably said cam surface is an undulating cam surface preferably without any sudden surface relief.

Preferably said cam surface is a sinusoidal wave form or similar in its developed condition.

Preferably the following surface of said cam follower is of a complementary shape to at least part of the cam surface of said cam.

Preferably the following surface of said cam follower is of a complementary shape to the cam surface of said cam.

Preferably said following surface of said cam follower snugly fits the cam surface of said cam when said rotation of said signage body is in its desired rotational orientation(s).

Preferably said axis of rotation is defined by at least one axle.

Preferably said axle carries one of said cam and cam follower the other carried by said signage body.

Preferably said axle carries one of said cam and cam follower in a manner to allow it to displace in a direction parallel to the axis of rotation yet be restrained form rotation relative to said axle.

Preferably it is splined to said axle.

Preferably a biasing means is provided to encourage the engagement of the cam follower with the cam surface of said cam.

Preferably said biasing means is a spring.

Preferably said biasing means is a coil spring.

Preferably at least two regions are planar regions and are each parallel to the axis of rotation.

Preferably said at least two regions are discrete regions.

Preferably there are two said regions which are diametrically opposite each other.

Preferably there are three said regions which are trimetrically opposite each other.

Preferably there are four said regions.

Preferably said regions are equi-spaced.

Preferably said regions extend a substantial length of the signage body in the direction parallel to the axis of rotation.

Preferably said signage body includes a cavity within which means to provide backlighting to said signage is provided.

Preferably said surface depression is provided in a sloping surface like manner of said cam surface, the surface save for at its lower point (and optionally at it higher point) having a tangent being non perpendicular to said axis of rotation.

Preferably said backlighting is mounted dependent from said means to mount wherein said signage body can rotate about said backlighting.

Preferably said signage substrate is at least in part translucent.

Preferably a reflector is mounted dependent from said means to mount wherein said signage body can rotate about said reflector, said reflector mounted to project light from said backlight towards where a said signage substrate will be positioned by said signage body for viewing.

Preferably said signage substrate is removeably mounted by said signage box.

Preferably said surface depression is such to have the cam follower bottom out when at the desired rotational location.

Preferably said desired rotational locations are spaced apart at intervals so as to present each region of said signage body in the same viewing orientation as the previous region rotated from said rotational location.

Preferably said signage body is of a kind as described in at least one of the patent specifications of NZ504716 and NZ527697, the contents of which is hereby incorporated.

In a second aspect the present invention consists in a rotatable display box comprising a signage body a means to mount said signage body to a fixed structure in a manner to allow the signage body to be rotatable about an axis of rotation and relative to said fixed structure wherein said signage body includes at least two regions at or from each of which a signage substrate is or can be presented, said regions being provided disposed for viewing of said signage substrate from a location outwardly away (ie not from a location on said axis of rotation) from the axis of rotation a means carried by said signage body for rotation about said axis of rotation and a means interactive with said means carried by said signage body said means interactive held stationary relative to any rotation of said signage body about the axis of rotation, wherein one of (a) said means carried by said signage body and (b) said means interactive, is a cam and the other is a cam follower, said cam presenting a cam surface to displace the cam follower parallel to the axis of rotation, said cam surface including a number of indexing zones corresponding to the number of regions at or from which signage is or can be presented, said indexing zones located at intervals about said axis of rotation corresponding to rotational locations of said signage box to which said rotation is to be biased to, said biasing to said locations encouraged by the biasing of said cam follower towards the cam surface of said cam.

Preferably said indexing zones are sloping surfaces.

In a further aspect the present invention consists in a menu board including the display box as herein before described.

In a further aspect the present invention consists in an orientation device for a rotatable display box of a kind which includes a signage body and a means to mount said signage body to a fixed structure in a manner to allow the signage body to be rotatable about an axis of rotation and relative to said fixed structure, said signage body including at least two regions at or from which signage is or can be presented, said regions being provided disposed for viewing of said signage from a location outwardly away (ie not from a location on said axis of rotation) from the axis of rotation, wherein said orientation device includes:

a means carried by said signage body for rotation about said axis of rotation and a means interactive with said means carried by said signage body said means interactive held stationary relative to any rotation of said signage body about the axis of rotation, wherein one of (a) said means carried by said signage body and (b) said means interactive, is a cam and the other is a cam follower, said cam presenting a cam surface to displace the cam follower parallel to the axis of rotation, said cam surface including a number of cam surface depressions corresponding to the number of regions at or from which signage is or can be presented, said cam surface depressions located at intervals about said axis of rotation corresponding to rotational locations of said signage box to which said rotation is to be biased to, said biasing to said locations encouraged by the biasing of said cam follower towards the cam surface of said cam.

In still a further aspect the present invention consists in a restaurant which includes a display box as herein before described.

In still a further aspect the present invention consists in a display box as herein described and with reference to any one or more of the accompanying drawings.

In yet a further aspect, the present invention consist in a three sided rotatable menu display board comprising, an elongate triangular cross section hollow structure (hereinafter "triangular structure") which defines three face sides at each of which a menu information carrying substrate can be presented, said triangular structure rotatably supportable, about an axis which is parallel to said elongate direction and which extends through said triangular section, from a fixed structure by mounting brackets to allow each of said three face sides to be sequentially presented for viewing to a region of perspective away from said triangular structure, wherein means to illuminate are provided within said triangular structure such that when energized, allow each said menu information carrying substrate to be backlit, and wherein a cam and interactive cam follower are provided, said cam mounted to one of said triangular structure and fixed structure and presenting an endless cam surface relative to which said cam follower, mounted to the other of said triangular structure and said fixed structure, can move upon the rotation of said triangular structure relative to said fixed structure, said cam follower and said cam being biased towards each other in the elongate direction, said cam surface including elongate direction elevation variation including three peaks positioned to encourage the movement of said triangular structure to a rotational position wherein said face sides are presented for viewing.

Preferably said means to illuminate is located within said triangular structure and is supported by said mounting brackets to remain stationary to said fixed structure yet allowing said triangular structure to rotate thereabout.

Preferably a reflector is located within said triangular structure, said reflector is supported by said mounting brackets to remain stationary to said fixed structure yet allowing said triangular structure to rotate thereabout and said reflector is positioned to reflect light from said illumination means in a direction towards said region of perspective.

In still a further aspect the present invention consists in a fast food outlet including a customer serving counter wherein a three sided rotatable menu display board as herein before described, carrying three menu information carrying substrates, one each affixed to a respective face side of said three sided rotatable menu display board, is mounted to a fixed structure of said fast food outlet to allow a sequential presentation of said face sides of said three sided rotatable menu display board to said customer serving counter.

Preferably each face side has affixed thereto at least one menu information carrying substrate, wherein said menu information carrying substrate of a first face side present menu information for food available to be ordered during a first time frame, and wherein said menu information carrying substrate of a second face side present menu information for food available to be ordered during a second time frame, and wherein said menu information carrying substrate of a thirst face side present menu information for food available to be ordered during a third time frame.

Figure 2:
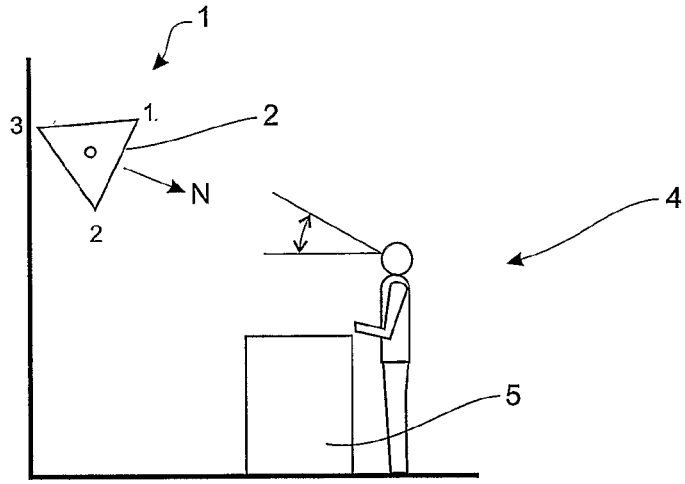
Figure 3:
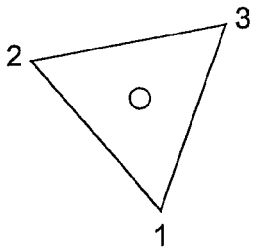
Figure 4:
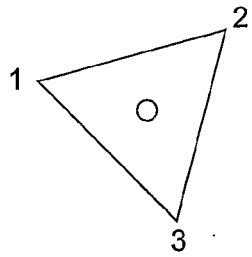
Figure 5:
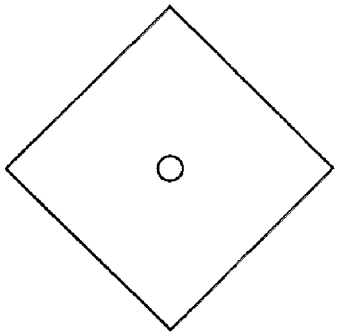
Figure 6:
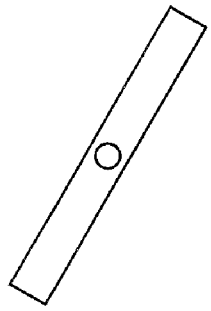
Figure 7:
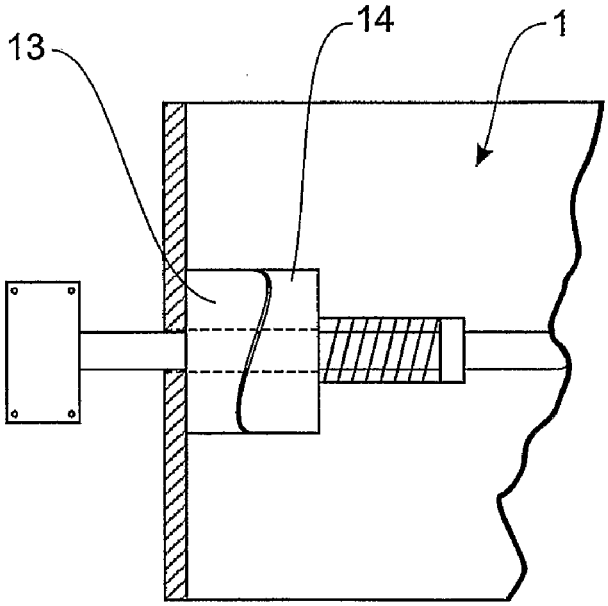
Figure 8:
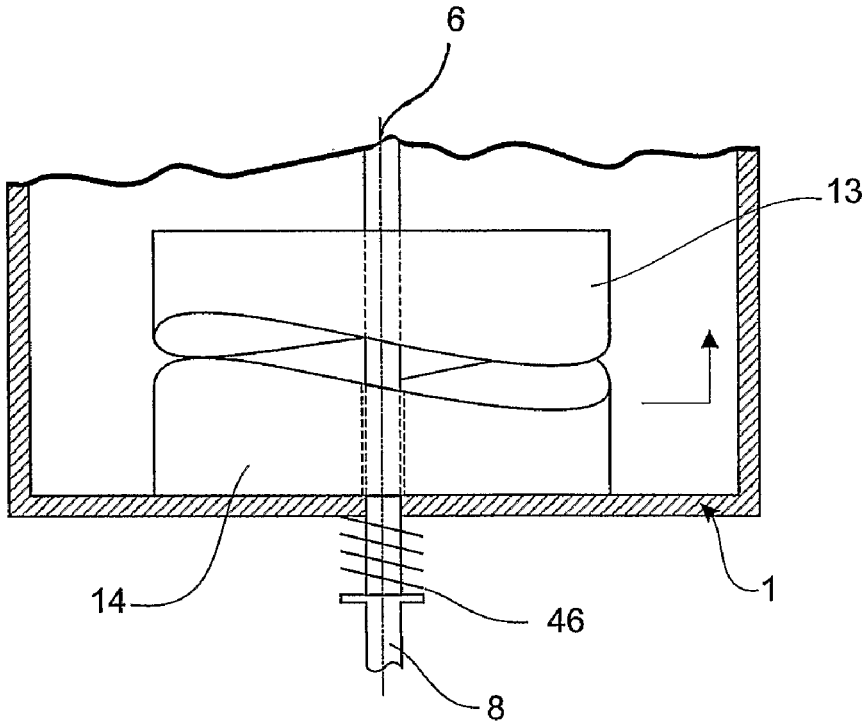
Figure 9:
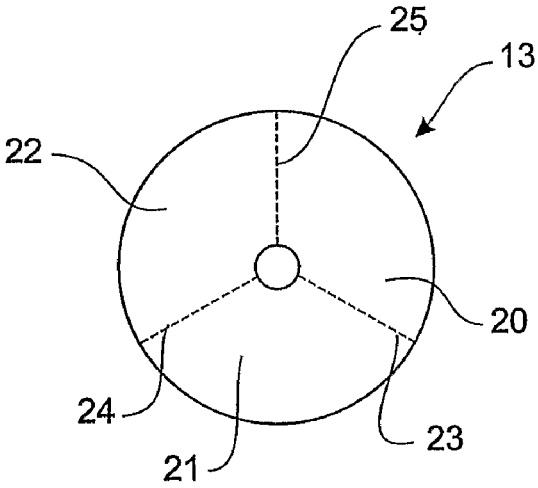
Figure 10:
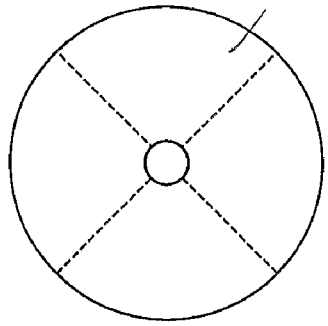
Figure 14:
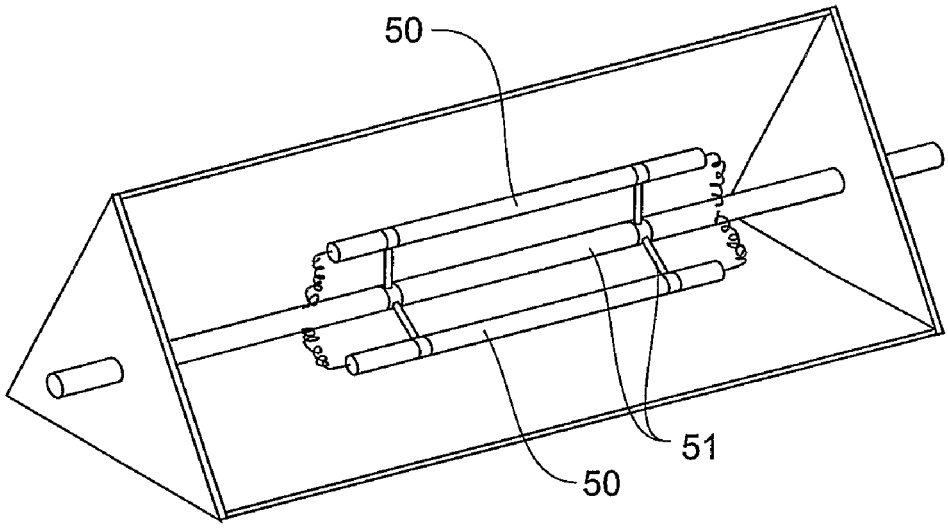
Figure 15:
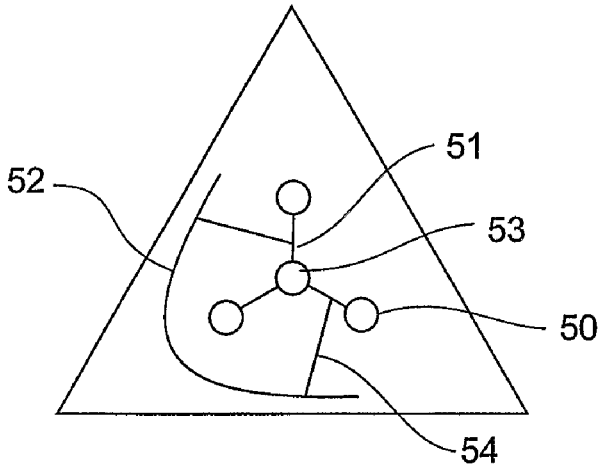
Figure 16:
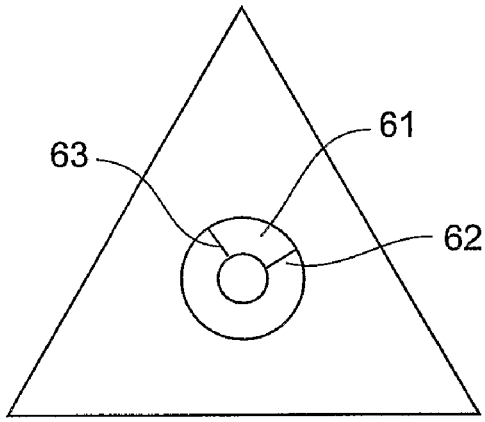
Figure 17:
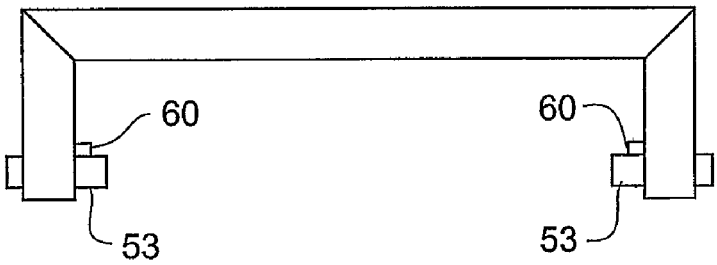

FIG. 1 is a perspective view of a display box or apparatus having for example a triangle prism shape and having an axis of rotation along the centre of the triangle prism according to a preferred embodiment of the invention, FIG. 2 is a side view of the display box of FIG. 1 mounted on a wall at the point-of-sale counter with a customer viewing display face 1-2 on the display apparatus, FIG. 3 is a side view of the display box with display face 1-3 facing the customer after a 120 degrees clockwise rotation of FIG. 2, FIG. 4 is a side view of the display box with display face 2-3 facing the customer after a 120 degrees clockwise rotation of FIG. 3, FIG. 5 is a side view of a four sided display box, FIG. 6 is a side view of a two sided display box, FIG. 7 is a side view of an orientation device in a display box, in a closed position, showing an axle having a cam located adjacent to a wall of the display box and an opposite facing cam follower engaged with a spring, FIG. 8 is a cross-section view of part of the cam and cam follower of an orientation as shown in FIG. 7 but in an open condition, FIG. 9 is a cross sectional view of the cam according to the preferred embodiment of the present invention for use with a three sided display box, FIG. 10 is a cross section view of a cam for a four-sided display box, FIG. 11 shows the rotation device as shown in FIG. 7 in an open condition, FIG. 12 shows a perspective view of an orientation device carrying a display apparatus and being mounted on the wall, and FIG. 13 is a view of a developed profile of the cam along its circumference with an alternative example of a cam follower in the form of a contact roller, FIG. 14 is a sectional view through of the three sided rotatable display device, FIG. 15 is a perspective view wherein one face side of the frame has been removed, FIG. 16 is an end view of the frame structure of the present invention illustrating the rotation limiting axle mounting region, FIG. 17 is a plan view of a mounting arrangement for the frame structure of the three sided rotatable sign.

DETAILED DESCRIPTION OF THE INVENTION

With reference to FIG. 1 there is shown a signage box or structure 1 which is substantially of a constant exterior cross section along its length in direction LL. The signage box includes three distinct faces 2. These faces or regions are capable of presenting or include signage information. Such signage information may for example be menu information or other information including graphic design for the purposes of advertising or conveying appropriate information to a viewer who may stand adjacent the signage box 1. With reference to FIG. 2, there is shown a setup where the signage box 1 is provided in for example a fast food restaurant where a person 4 standing adjacent a counter 5 is able to view the face 2 intermediate the longitudinal edges 1-2 of the signage box 1.

The signage box as shown in FIG. 1 is of a kind which is capable of rotation. Rotation allows for the different faces of the signage box to be presented to a person. Rotation of the signage box is preferably about an axis of rotation 6 which extends parallel to the longitudinal direction LL of the signage box 1 and preferably through the signage box. In the examples shown in FIGS. 1-4, the signage box has an exterior which is substantially of a triangular cross section (a cross section perpendicular to the longitudinal direction LL) thereby providing three faces or regions 2, from which a signage or signage substrate can be presented. In for example a fast food outlet, where different food may be served at breakfast, lunch and dinner, separate menus need to be displayed. Such a three sided signage box 1 can be used for the convenient display of all three different menus. It is however desirable that upon the rotation of the signage box 1 (which normally occurs manually) that the face to be presented for viewing to the viewer 4 is rotated to a correct orientation. It can be seen for example in FIG. 2 that the face 2 between edges 1, 2 of the signage box 1, has its Normal (N) projecting substantially towards the eyes of the viewer. Rotation of the signage box 1 is to be such that each face when presented for viewing assumes substantially the same orientation to the direction of viewing.

The signage box 1 as for example shown in FIG. 12 may be mounted to a wall 6 of a building or structure. Such mounting may be by mounting brackets 7 disposed at each end of the signage box 1. The mounting brackets may include an axle 8 which extends at least relative to and proximate to each of the ends 9, 10 of the signage box 1 or substantially through the signage box. The axle 8 may be a stub axle or a through axle passing entirely through the signage box 1.

In order to aid in the encouragement of the rotation of the signage box to one of three preferred rotational orientations (this being for the three sided sign example) a cam and cam follower arrangement is provided. With reference to FIG. 11, it can be seen that a cam and cam follower arrangement 12 is provided internal of the signage box 1. This arrangement includes a cam 13 and a cam follower 14. In this example as shown in FIG. 11, the cam is engaged to the structure of the signage box 1 in a fixed manner. For example the cam 13 is engaged to the end plate defining the end 10 of the signage box 1. The cam 13 cannot move relative to the signage box 1. A cam follower is disposed to remain stationary relative to the fixed structure in at least its rotational sense but can move in a direction parallel to the axis of rotation 6. The cam follower 14 is for example mounted on the axle 8 in a manner to be slidable therealong (in a direction parallel to the rotational axis 6) but is prevented from rotating with the signage box 1. The cam follower 14 may be splined to the axle 8 to prevent from rotating about the axis 6. The ability for the cam 13 to rotate about the axis of rotation 6 and the inability for the cam follower 14 to rotate about the axis of rotation 6 results in a relative rotational movement being established between the cam 13 and the cam follower 14.

As can be seen with reference to FIG. 11, the cam follower is preferably of a nature to be coaxial with the axis of rotation 6. The cam 13 includes an undulating surface or wave like surface about the axis of rotation 6. FIG. 13 for example shows the developed surface taken at one radius from the axis of rotation 6-6 of the cam 13. The undulating surface 19 may for example be of a sinusoidal wave form. The undulating surface has variation in amplitude in a direction parallel to the axis of rotation 6 thereby resulting in the movement of the cam follower 14 in a direction parallel to the axis of rotation 6 when there is relative rotational movement between the cam 13 and the cam follower 14.

With reference to FIG. 9, the cam 13 is shown to be divided into three zones 20, 21 and 22. Each zone is segregated by a trough 23, 24 and 25 at where the undulating surface is at its minimum amplitude. With reference to for example FIG. 13, it can be seen where these troughs are provided. The troughs 23, 24 and 25 represent a bottoming out of the movement of the cam follower 14 in one direction along the axis of rotation 6. It is in this direction that the cam follower 14 is biased towards by a spring 28. As can be seen in FIG. 11, the spring 28 pushes the cam follower 14 for engagement with the undulating surface 19 of the cam 13. Since the undulating surface 19 is of a gradual changing slope like nature (and preferably does not include any sudden changes in slope) upon the rotation of the signage box 1 a continuous but gradual movement of the cam follower 14 in a direction parallel to the axis of rotation 6 will occur. Since the spring 28 will wish to encourage the cam follower 14 to move in direction Z and displace the cam follower 14 in direction Z as far as possible, the cam follower will be urged to make contact with the undulating surface 19 of the cam 13 so as to encourage movement of the cam follower to the trough locations 23, 24 and 25. In a simplified form as shown in FIG. 13, the cam, follower 14 is for example a wheel 31 biased by the spring 28 in direction Z. In the position as shown in FIG. 13, the pressure applied by the wheel 13 in direction Z will encourage the movement of the cam 13 in direction Y until the wheel reaches the trough 23.

Appropriate rotational alignment of the cam 13 with the signage box 1 will ensure that the signage box 1 is encouraged to rotate to an orientation or orientations where the signage face 2 or faces 2 are presented in the desired rotational orientation as hereinbefore mentioned. The spring 28 may be held by a bush 41 to be captured between the bush 41 and the cam follower 14.

In a preferred form, the cam follower 14 is of a surface profile to engage with the undulating surface 19 of the cam 13 substantially complimentary with at least part of the undulating surface 19 of the cam 13. Indeed in the most preferred form the surface of the cam follower 14 is substantially complimentary with the undulating surface 19 of the cam 13. As can be seen in FIG. 7, when the cam follower 14 is in a position where the signage box 1 is rotated to one of its preferred rotation orientations the mating surfaces of the cam follower and cam are tight. FIG. 8 is a cross sectional view through a cam and cam follower illustrating such preferred complimentary shaped camming surfaces. Furthermore FIG. 8 illustrates an alternative embodiment of the present invention where the cam 13 forms part of and remains affixed both rotationally and translationally relative to the axle 8. In this configuration it is the signage box 1 which is again rotatably mounted about the axle 8 but also is capable of moving in a translational manner in a direction parallel to the axis of rotation 6. The cam follower 14 is in this instance affixed to the signage box 1 both in a translational and rotational sense and is biased by the spring 46 towards the cam 13 carried by the axle 8. Accordingly it is either the cam or the cam follower that is engaged with the signage box 1.

Alternative configurations will also for example include a four sided sign as shown in FIG. 5 wherein for example the cam will be divided into quadrants as shown in FIG. 10. Likewise a two sided sign may also be utilised and an appropriately segmented cam and/or cam follower will need to be utilised. The number of segments of the cam will be directly corresponding to the number of sides that the signage box will provide.

The signage box 1 may further include additional features such as those which are for example described in our New Zealand patent applications NZ504716 and NZ527697, which are hereby referenced and incorporated into this patent specification.

Such additional features may include internal backlighting as shown in FIGS. 14 through 17. Located within the cavity of the elongate triangular section frame are the means to illuminate which consists preferably of at least one fluorescent light tube 50. Alternatively a plurality of such tubes may be provided. The illumination means provide backlighting to the menu information to be displayed by the three-sided rotational display sign of the present invention. The means to illuminate preferably remain stationary relative to the fixed structure. Accordingly the elongate triangular section frame will rotate about the means to illuminate. Additional electrics or electronics such as capacitors or starters may need to be provided and these can also be mounted within the cavity and remain stationary relative to the fixed structure. A reflective device 52 is preferably provided interior of the triangular section and is provided to remain stationary relative to the lighting means 50 and the preferred stationary axle 53 extending through the triangular frame section. The reflective means 52 preferably extends to the same extent as the lighting tubes 50 which are the preferred form of the illumination means of the device. The reflector 52 may preferably extend the full length of the interior cavity of the triangular section frame. Brackets 54 may be provided for supporting the reflector 52 from the axle 53 or from the brackets 51. The reflector is positioned so as to reflect light in the viewing direction and will cast the light from the illumination means 50 in that direction which when a face of the triangular section frame is disposed within the line of sight from a consumer with the sign, will direct the light towards the image substrate thereby providing all of the illumination energy in that direction.

The means to illuminate may hence be mounted from or at least dependent from the stationary axles 53 which mount the elongate triangular section frame. The means to illuminate may be supported by a bracket or other like mounting 51 which is engaged to the axles 53 for example at each end of the elongate triangular section frame. An electrical cable can be fed via a conduit or passageway provided through the axles 53 and through the mounting brackets 7 into the cavity to provide for energisation to the fluorescent tubes. Alternatively such wiring can be provided from external of the axle 53.

Where wiring is provided external from the axle 53 and into the cavity, it may become an issue that the cabling is prevented from being wound about the axle 53. Rotation of the elongate triangular section frame may need to be limited to ensure that the cable does not wind itself up and thereby cause electrical problems. Accordingly a stopper 60 (FIG. 17) is disposed from the mounting bracket 7 on at least one of the mounting brackets 7. The stopper 60 is offset from the axis of rotation provided by the axle 53. An upstand 61 is also provided dependent from the end or capping members 4. The upstand 61 (FIG. 16) is also offset from the axis of rotation and provides stopping surfaces 63 and 62 beyond which rotation of the triangular section frame member cannot rotate as a result of the engagement between the upstand 60 and the upstand 61. In this manner rotation of the rotatable display sign can be limited to within less than 360 degrees. Preferably the rotation is not limited to anything less than 260 degrees.

The invention claimed is:

1. A rotatable display box comprising, a signage body a means to mount said signage body to a fixed structure in a manner to allow the signage body to be rotatable about an axis of rotation and relative to said fixed structure, wherein said signage body includes at least two regions at or from each of which a signage substrate is or can be presented, said regions being provided disposed for viewing of said signage substrate from a location outwardly away from the axis of rotation, a means carried by said signage body for rotation about said axis of rotation and a means interactive with said means carried by said signage body said means interactive held stationary relative to any rotation of said signage body about the axis of rotation, wherein one of (a) said means carried by said signage body and (b) said means interactive, is a cam and the other is a cam follower, said cam presenting a cam surface to displace the cam follower parallel to the axis of rotation, said cam surface including a number of cam surface depressions corresponding to the number of regions at or from which signage is or can be presented, said cam surface depressions located at intervals about said axis of rotation corresponding to rotational locations of said signage box to which said rotation is to be biased to, said biasing to said locations encouraged by the biasing of said cam follower towards the cam surface of said cam.

2. The rotatable display box as claimed in claim 1 wherein the following surface of said cam follower is of a complementary shape to at least part of the cam surface of said cam.

3. The rotatable display box as claimed in claim 1 wherein the following surface of said cam follower is of a complementary shape to the cam surface of said cam.

4. The rotatable display box as claimed in claim 1 wherein said axis of rotation is defined by at least one axle.

5. The rotatable display box as claimed in claim 4 said axle carries one of said cam and cam follower the other carried by said signage body.

6. The rotatable display box as claimed in claim 1 wherein a biasing means is provided to encourage the engagement of the cam follower with the cam surface of said cam.

7. The rotatable display box as claimed in claim 6 wherein said biasing means is a spring.

8. The rotatable display box as claimed in claim 1 wherein said at least two regions are planar regions and are each parallel to the axis of rotation.

9. The rotatable display box as claimed in claim 1 wherein said signage body includes a cavity within backlighting for said signage is provided.

10. The rotatable display box as claimed in claim 1 wherein said surface depression is provided by a sloping surface of said cam surface, the surface save for at its lower point (and optionally at it higher point) having a tangent being non perpendicular to said axis of rotation.

11. The rotatable display box as claimed in claim 1 wherein said desired rotational locations are spaced apart at intervals so as to present each region of said signage body in the same viewing orientation as the previous region rotated from said rotational location.

12. A rotatable display box comprising, a signage body, a means to mount said signage body to a fixed structure in a manner to allow the signage body to be rotatable about an axis of rotation and relative to said fixed structure, wherein said signage body includes at least two regions at or from each of which a signage substrate is or can be presented, said regions being provided disposed for viewing of said signage substrate from a location outwardly away (ie not from a location on said axis of rotation) from the axis of rotation, a means carried by said signage body for rotation about said axis of rotation and a means interactive with said means carried by said signage body said means interactive held stationary relative to any rotation of said signage body about the axis of rotation, wherein one of (a) said means carried by said signage body and (b) said means interactive, is a cam and the other is a cam follower, said cam presenting a cam surface to displace the cam follower parallel to the axis of rotation, said cam surface including a number of indexing zones corresponding to the number of regions at or from which signage is or can be presented, said indexing zones located at intervals about said axis of rotation corresponding to rotational locations of said signage box to which said rotation is to be biased to, said biasing to said locations encouraged by the biasing of said cam follower towards the cam surface of said cam.

13. The rotatable display box as claimed in claim 12 wherein said indexing zones are sloping surfaces.

14. The restaurant which includes a display box as claimed in claim 1.

15. The display box as claimed in claim 1 and with reference to any one or more of the accompanying drawings.

16. The rotatable display box as claimed in claim 9 wherein said backlighting is mounted dependent from said means to mount wherein said signage body can rotate about said backlighting.

17. The rotatable display box as claimed in claim 9 wherein said signage substrate is at least in part translucent.

18. The rotatable display box as claimed in claim 16 wherein a reflector is mounted dependent from said means to mount wherein said signage body can rotate about said reflector, said reflector mounted to project light from said backlight towards where a said signage substrate will be positioned by said signage body for viewing.

19. The rotatable display box as claimed in claim 1 wherein said signage substrate is removeably mounted by said signage box.

20. A three sided rotatable menu display board comprising an elongate triangular cross section hollow structure (hereinafter "triangular structure") which defines three face sides at each of which a menu information carrying substrate can be presented, said triangular structure rotatably supportable, about an axis which is parallel to said elongate direction and which extends through said triangular section, from a fixed structure by mounting brackets to allow each of said three face sides to be sequentially presented for viewing to a region of perspective away from said triangular structure wherein means to illuminate are provided within said triangular structure such that when energized, allow each said menu information carrying substrate to be backlit and wherein a cam and interactive cam follower are provided, said cam mounted to one of said triangular structure and fixed structure and presenting an endless cam surface relative to which said cam follower, mounted to the other of said triangular structure and said fixed structure, can move upon the rotation of said triangular structure relative to said fixed structure, said cam follower and said cam being biased towards each other in the elongate direction, said cam surface including elongate direction elevation variation including three peaks positioned to encourage the movement of said triangular structure to a rotational position wherein said face sides are presented for viewing.

21. The three sided rotatable menu display board as claimed in claim 20 wherein said means to illuminate is located within said triangular structure and is supported by said mounting brackets to remain stationary to said fixed structure yet allowing said triangular structure to rotate thereabout.

22. The three sided rotatable menu display board as claimed in claim 19 wherein a reflector is located within said triangular structure, said reflector is supported by said mounting brackets to remain stationary to said fixed structure yet allowing said triangular structure to rotate thereabout and said reflector is positioned to reflect light from said illumination means in a direction towards said region of perspective.

23. The fast food outlet including a customer serving counter wherein a three sided rotatable menu display board as claimed in claim 20, carrying three menu information carrying substrates, one each affixed to a respective face side of said three sided rotatable menu display board, is mounted to a fixed structure of said fast food outlet to allow a sequential presentation of said face sides of said three sided rotatable menu display board to said customer serving counter.

24. The fast food outlet as claimed in claim 23 wherein each face side has affixed thereto at least one menu information carrying substrate, wherein said menu information carrying substrate of a first face side present menu information for food available to be ordered during a first time frame, and wherein said menu information carrying substrate of a second face side present menu information for food available to be ordered during a second time frame, and wherein said menu information carrying substrate of a thirst face side present menu information for food available to be ordered during a third time frame.

* * * * *